US005464174A

United States Patent [19]

Laures

[11] Patent Number: 5,464,174

[45] Date of Patent: Nov. 7, 1995

[54] AIR DEFENCE SYSTEM AND DEFENCE MISSILE FOR SUCH A SYSTEM

[75] Inventor: Pierre Laures, Chatenay Malabry, France

[73] Assignee: Aerospatiale Societe Nationale Industrielle, Paris, France

[21] Appl. No.: 332,793

[22] Filed: Nov. 2, 1994

[30] Foreign Application Priority Data

Nov. 25, 1993 [FR] France ..... 93 14082

[51] Int. Cl.[6] ..... F42B 15/10

[52] U.S. Cl. ..... 244/3.11; 244/3.15; 244/3.16; 89/1.11

[58] Field of Search ..... 89/1.11; 102/213, 102/492; 244/3.11, 3.15, 3.16

[56] References Cited

U.S. PATENT DOCUMENTS

| | | | |
|---|---|---|---|
| 3,206,144 | 9/1965 | Welti | 244/3.15 |
| 3,924,826 | 12/1975 | Reinert | 244/3.16 |
| 3,964,695 | 6/1976 | Harris | 244/3.16 |
| 4,087,061 | 5/1978 | Burt | 244/3.16 |
| 4,098,191 | 7/1978 | Bagwell et al. | 102/213 |
| 4,848,239 | 7/1989 | Wilhelm | 102/213 |
| 4,925,129 | 5/1990 | Salkeld et al. | 244/3.11 |
| 5,050,818 | 9/1991 | Sundermeyer | 244/3.15 |
| 5,080,300 | 1/1992 | Stubbs et al. | 244/3.11 |
| 5,112,006 | 5/1992 | Palmer | 244/3.16 |
| 5,196,645 | 3/1993 | Wisshaupt | 102/213 |
| 5,368,254 | 11/1994 | Wickholm | 244/3.16 |

FOREIGN PATENT DOCUMENTS

| | | |
|---|---|---|
| 4018198 | 9/1991 | Germany . |
| 2212252 | 7/1989 | United Kingdom . |

*Primary Examiner*—Charles T. Jordan
*Assistant Examiner*—Theresa M. Wesson
*Attorney, Agent, or Firm*—Fisher, Christen & Sabol

[57] ABSTRACT

Air defense system capable of intercepting high-speed airborne missiles (3), including a fixed control installation (1) and defense missiles (2).

According to the present invention:

at the point (F) common to the approach trajectory (T) of the said airborne missile (3) and to the interception trajectory (t) of the said defense missile (2), the said interception trajectory is transversal to the approach trajectory;

the central axis of the homing head of the defense missile (2) is inclined laterally with respect to the axis of the said defense missile (2); and the said defense missile (2) is roll-stabilized, so that the said central axis of the said homing head is arranged on the side of the said airborne missile (3).

13 Claims, 4 Drawing Sheets

FIG. 4
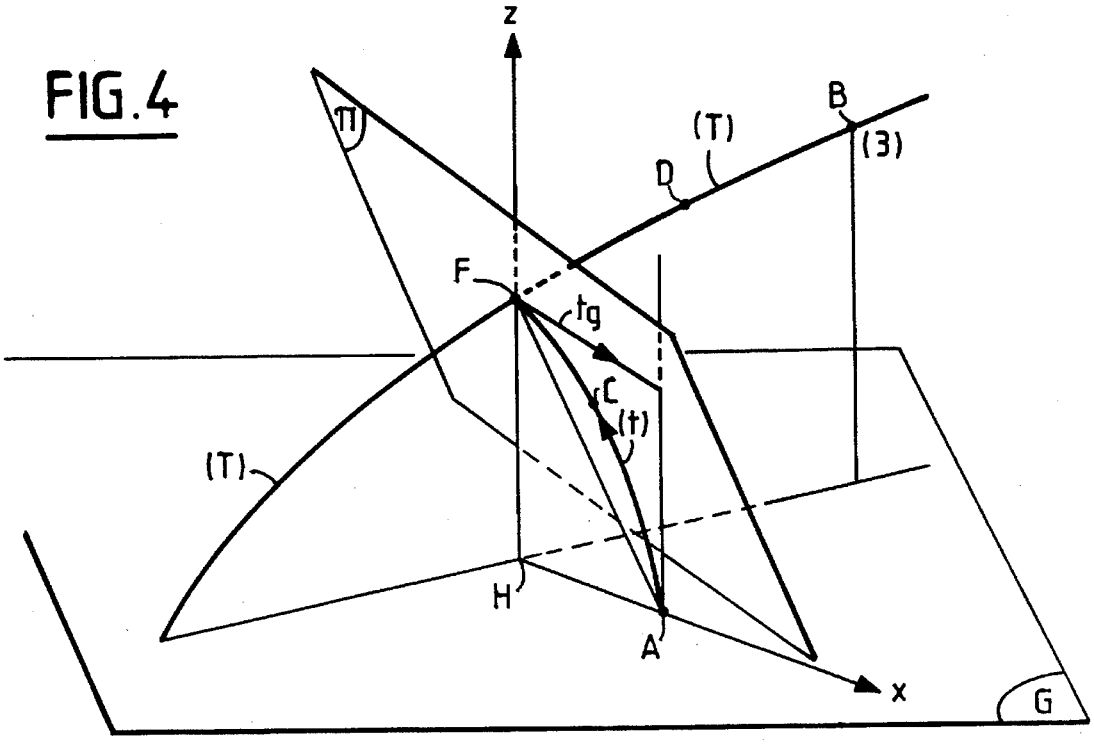
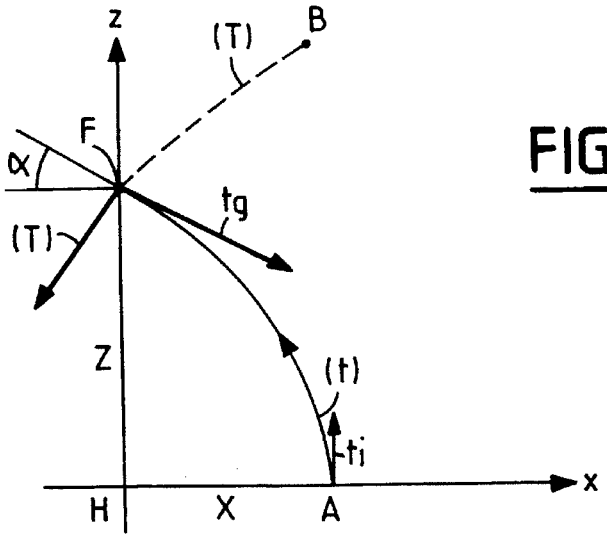
FIG. 5

AIR DEFENCE SYSTEM AND DEFENCE MISSILE FOR SUCH A SYSTEM

The present invention relates to an air defence system able to intercept airborne missiles, for example ballistic missiles, flying at high speed (for example in the range from Mach 3 to Mach 10), as well as a defence missile for such a system.

An air defence system is already known (see, for example, the patent FR-A-2 563 000), including a fixed control installation and defence missiles, the said fixed installation comprising:

- means for detecting the said airborne missiles;
- trajectory calculation means for determining the approach trajectory and the speed of such an airborne missile, detected by the said detection means;
- calculation means for determining an interception trajectory which one of the said defence missiles has to follow in order to intercept the said detected airborne missile;
- means for launching the said defence missile;
- means for guiding the said defence missile; and
- means for linking with the said defence missile, while each of the said defence missiles includes a propulsion system, at least one warhead, an inertial unit, a homing head, steering devices, means for linking with the said fixed control installation and a steering commands generator deriving the said steering commands from information sent by the said guidance means provided in the said fixed control installation and from information delivered by the said homing head.

In such an air defence system, the homing head is arranged at the front of the defence missile, within a radome forming the nose of the said missile, the central axis of the said homing head being coincident with the longitudinal axis of the said missile, while the interception trajectory followed by the said defence missile is such that it attacks the airborne target from the front or from the rear. However, if the airborne target is very fast, only the frontal attack is realistic.

However, such a frontal attack entails the interception trajectory being necessarily lengthy, such that the interception time (between the launch of the missile and the interception proper) is also long and the interception happens at high altitude. Since the interception time is long, the time available for preparation for the firing and for the firing of the defence missile after detection of the target is very short and the defence missile must be placed as close as possible to the sites to be defended against the said airborne missiles. Moreover, since interception happens at high altitude, it takes place in the high atmospheric layers, in which the defence missile becomes less manoeuvrable.

Moreover, the destruction of an airborne target by direct frontal impact of a defence missile being very improbable, there is provided, on board the said known defence missiles, a conventional warhead capable of projecting a widely spaced shower of fragments around the said missiles, over a surface of revolution with axis coincident with the longitudinal axis of the said missiles.

However, during the frontal attack of a very fast target, the relative speed between the defence missile and the target is then practically parallel to the axis of the target, so that only the part of the shower of fragments directed towards the said target may possibly reach the latter and such that, in this case, the direction along which the said fragments arrive on the target is only slightly inclined to the axis of the said target. For example, if the airborne target is flying at a speed VB=2000 m/s, while the speed VE of the defence missile is equal to 1000 m/s and the speed VI of the fragments is equal to 1500 m/s, it is easily verified that the angle of inclination of the fragments reaching the target is inclined by about 26 degrees to the axis of the latter.

From this low inclination of the shower of fragments with respect to the axis of the airborne target, it results that:

- the said fragments reach the rear of a long target, where it is most resistant, due to the siting of its propulsive system;
- the said fragments pass behind the target, without hitting it, if this target is short and;
- in any event, the said fragments reaching the target rebound from it or penetrate only superficially, without occasioning fatal damage.

In order to attempt to remedy these drawbacks resulting from the reduction in the effectiveness of conventional fragmentation charges as a function of the speed of the airborne target, various means have been envisaged, such as increasing the speed of the fragments, development of a cloud of fragments accompanying the defence missile, development of a rigid "umbrella" around the defence missile, etc. However, none of these means has proved to be effective, so that the known air defence systems are effective only for airborne targets flying at Mach 4 at the very most.

The object of the present invention is to remedy the abovementioned drawbacks and relates to an air defence system of the type described above for which the interception trajectory and the interception time are short, so that interception can take place at low altitude and so that the said system can be sited far from a site to be protected, while creating sufficient time to prepare and carry out firing of a defence missile. Moreover, the air defence system according to the invention makes it possible, when it employs lateral projection of fragments, to obtain an impact direction transversal to the axis of the target.

To this end, according to the invention, the air defence system, capable of intercepting high-speed airborne missiles, is noteworthy in that:

- at the point common to the approach trajectory of the said airborne missile and to the interception trajectory of the said defence missile, the said interception trajectory is transversal to the approach trajectory;
- the central axis of the said homing head is inclined laterally with respect to the axis of the said defence missile; and
- the said defence missile is roll-stabilized, so that the said central axis of the said homing head is arranged on the side of the said airborne missile.

Thus, in the air defence system in accordance with the present invention, the defence missile looks laterally (and not forward, like the known defence missiles) and attacks the airborne target transversely (and not from the front or from the rear, like the known defence missiles), so that the interception trajectory and the interception time are greatly shortened, which procures the abovementioned advantages.

Advantageously, the said calculating means determining the interception trajectory of the said defence missile:

- start by determining the said point common to the said interception and approach trajectories; then
- in the vertical plane passing through the said common point and through the site of the said defence missile on the ground, determine the said interception trajectory of the said defence missile from the following three parameters:
  - the vertical distance separating the said common point from its horizontal projection;

the horizontal distance separating the said site of the defence missile on the ground from the said horizontal projection of the said common point; and the angle which the intersection of the said vertical plane with the plane normal to the said approach trajectory of the said airborne missile, at the said common point, makes with the horizontal.

Moreover, it is advantageous that the said calculation means:

with the aid of the said three parameters, determine the interception time necessary for the said defence missile to cover the said interception trajectory between the said site of the defence missile on the ground and the said point common to the said interception and approach trajectories;

continuously calculate the flight time necessary for the said airborne missile to reach the said common point from its current position, by following the said approach trajectory; and actuate the said means of launching the said missile so that the said launching means perform the launch firing of the missile when the said airborne missile reaches the point of the said approach trajectory for which the value of the said flight time becomes equal to the said interception time.

Moreover, in order for the homing head of the defence missile to be able to lock on to the said airborne missile while it describes the interception trajectory, it is arranged that, at the estimated moment of lock-on at the latest, the central axis of the said homing head is in the plane defined by the position of the defence missile, the said common point and the location at this instant of the said airborne missile, and that this latter plane serves as reference plane for the roll stabilization of the said defence missile.

Thus, the essential feature of the air defence missile in accordance with the present invention resides in that the central axis of its homing head is inclined laterally with respect to the axis of the said defence missile.

For preference, the value of the lateral inclination angle of the central axis of the said homing head with respect to the axis of the said missile is chosen in such a way that its tangent is at least approximately equal to the ratio between the speed of the airborne missile to be intercepted and the speed of the said defence missile. In the case in which the said defence missile has to intercept a very fast ballistic missile, this angle may be close to 60 degrees.

Obviously, in order to facilitate lock-on to the target by the homing head, it is advantageous for the said central axis of the homing head to be able to be oriented around the mid position corresponding to the angle defined above, for example within a cone, the half-angle of which at the vertex may be approximately equal to 40 degrees.

The missile according to the present invention may be meant to destroy the airborne target by direct impact or equally by blast effect by the explosion of the warhead which it carries when the said target is in immediate proximity.

However, as is usual and described above, it may include a warhead with lateral projection of fragments.

In this case, if the speed of the airborne missile to be intercepted is very high, it is sufficient to provide for the said shower of fragments to be projected laterally, on the side opposite the central axis of the homing head. In effect, in this case, the relative speed between the defence missile and the airborne target, without being perpendicular to the axis of the said missile, is, however, transversal to this latter axis, so that the shower of fragments projected on the opposite side from the homing head reaches the target at a large angle with respect to the axis of the said target. Taking the above example again, with VB=2000 m/s, VE=1000 m/s and VI–1500 m/s, it is easy to show that the fragments of the said shower reach the airborne target at an angle greater than 60 degrees (compared with the value of 26 degrees above).

Thus the drawbacks of ineffectiveness of destruction mentioned above apropos of the known systems are avoided. The fragments of the said lateral shower may thus reach the said target in its mid part and penetrate deeply therein in order to destroy it. In what follows, it will easily be seen in this context, that the fragments are all the more destructive the higher the speed of the airborne missile to be intercepted.

Moreover it can be seen that, by virtue of the invention, it is pointless to disperse the said shower all around the defence missile and that, on the contrary, it can be concentrated in the direction opposite to the homing head.

In a known way, the defence missile in accordance with the present invention may include a proximity fuse for detecting the airborne missile in the vicinity of the point common to the approach and interception trajectories and for controlling the said warhead. Such a proximity fuse could, as is usual, generate a conical detection front centred on the axis of the defence missile. However, in the present case, it is sufficient for the said proximity fuse to form a detection front in the form of a plane layer, inclined laterally with respect to the axis of the said missile, on the same side as the central axis of the said homing head.

The lateral inclination angle of the said detection front may be approximately equal to 30 degrees.

For preference, the said homing head is arranged in an intermediate part of the said defence missile. Thus, the latter may not include a front radome, so that its front part may be pointed, elongate and tapered in order to impart good aerodynamic properties to the said defence missile.

The figures of the attached drawing will make it easy to understand how the invention can be produced. In these figures, identical references designate similar elements.

Figure 3:
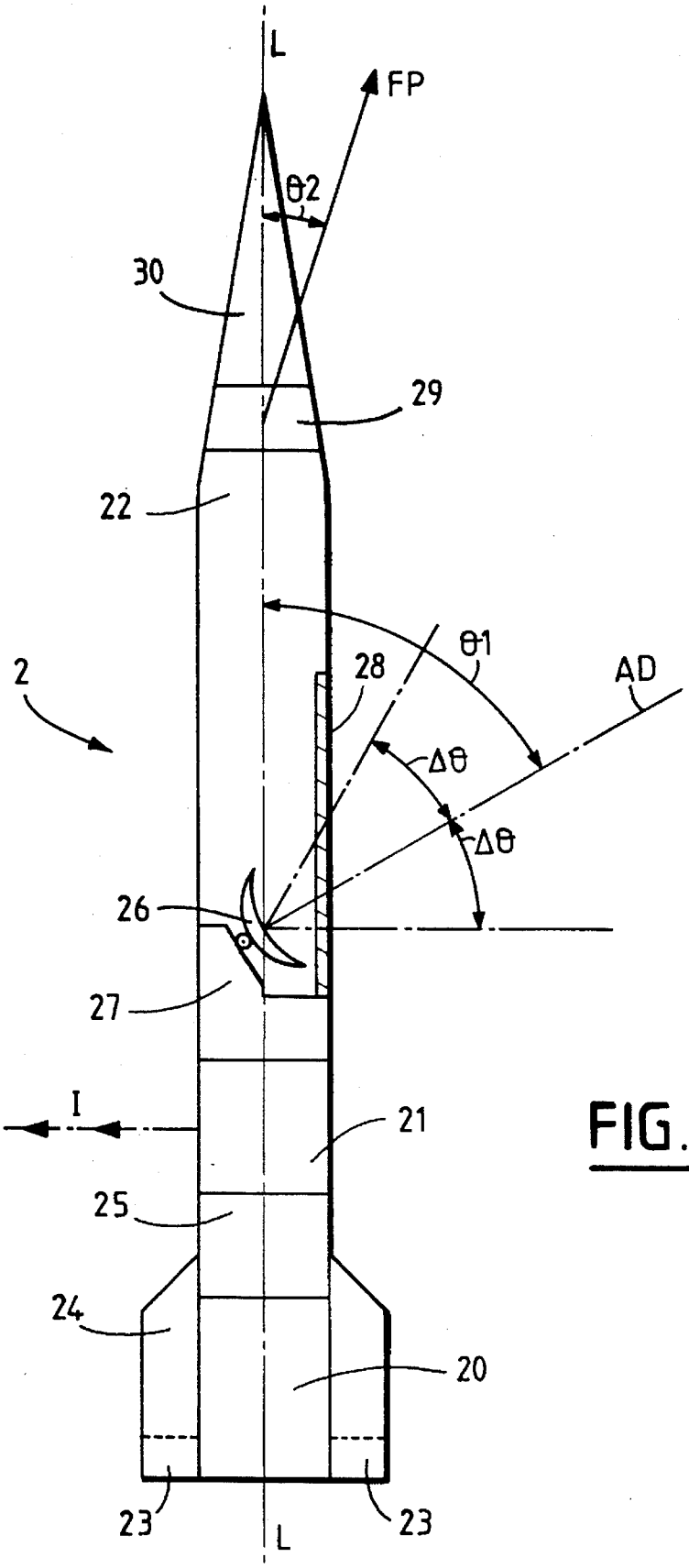

FIG. 3 diagrammatically shows a defence missile in accordance with the present invention.

FIG. 4 is a diagrammatic view in perspective illustrating the determination of the interception trajectory followed by a defence missile.

FIG. 5 shows the parameters defining the interception trajectory.

Figure 6:
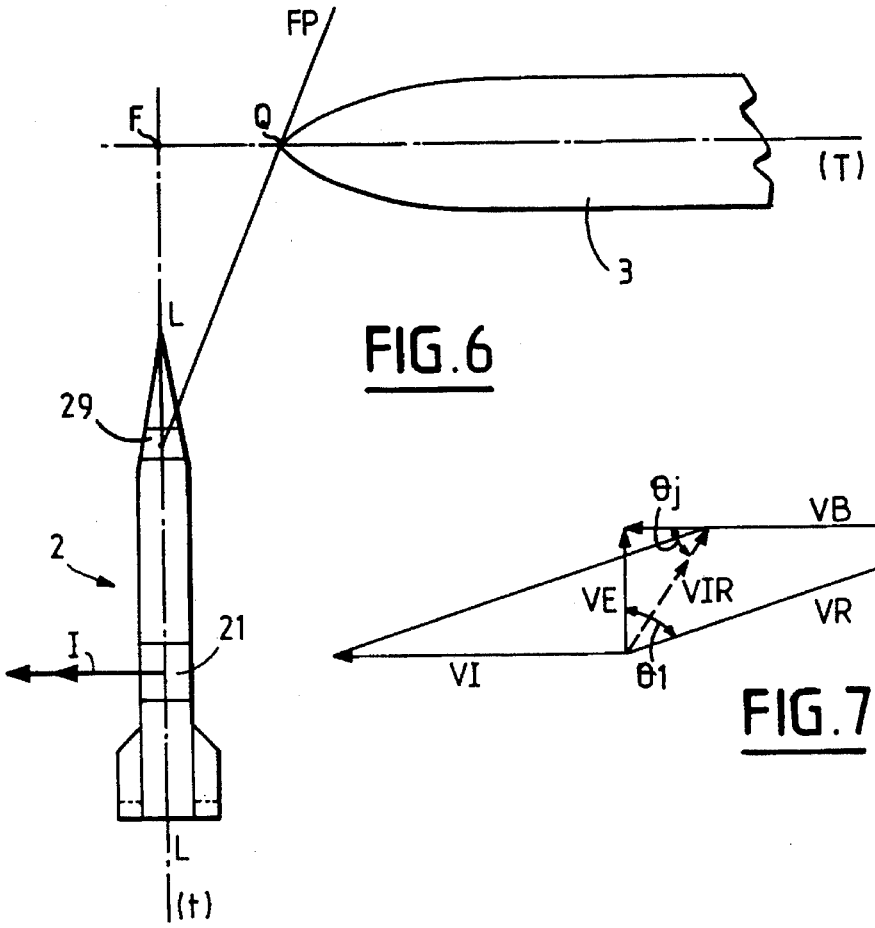

FIG. 6 diagrammatically illustrates the start of the final phase of the interception, at the moment of detection of the said airborne missile by the proximity fuse of the defence missile.

Figure 7:
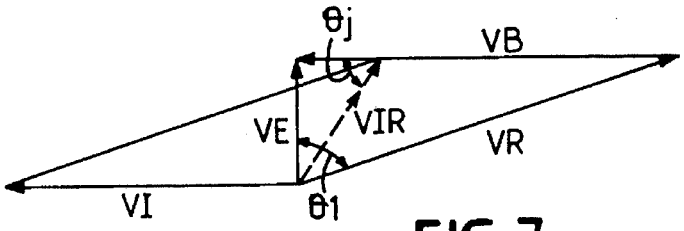

FIG. 7 is a diagram of the speeds at the moment of the detection illustrated by FIG. 6.

Figure 8:
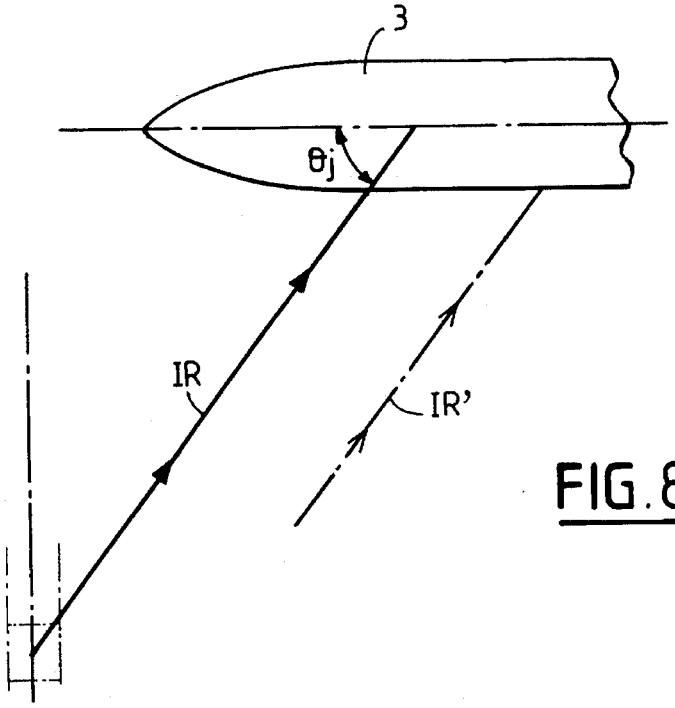

FIG. 8 diagrammatically illustrates the impact of the shower of fragments on the said airborne missile.

Figure 1:
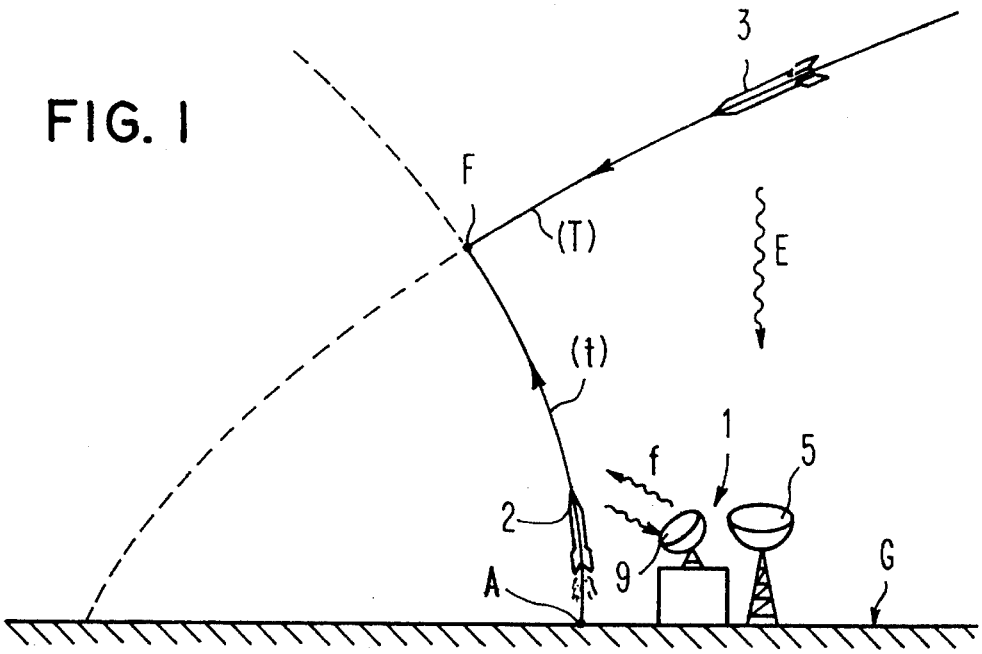
FIG. 1 is a general diagrammatic view illustrating the implementation of the air defence system in accordance with the present invention.

The air defence system according to the invention, illustrates diagrammatically by FIG. 1, includes a surveillance and control installation 1, set up on the ground G, as well as a set of air defence missiles 2. When an enemy airborne missile, especially a high-speed ballistic missile, is detected and identified by the installation 1 (arrow E), the latter, with the aid of the radars and of the computers which it includes, determines the opportunity and the conditions for an interception of the missile 3.

If interception is decided upon, the installation 1 determines the speed VB of the enemy missile 3, which then becomes the target to be shot down, as well as the approach trajectory T followed by the said missile 3, and calculates an interception trajectory t which a defence missile 2, on launch standby at an emplacement A, has to follow to intercept the missile 3 at a point F, at which the said trajectories T and t cross at an angle at least substantially equal to 90 degrees. The installation 1 then proceeds to launch the said defence missile 2, at an instant such that, having regard to the speed capabilities of a defence missile 2, the latter and the said missile 3 find themselves at the same instant at the point F, or at least in the vicinity of this point.

As will be seen later, each defence missile 2 includes electronic guidance means capable of cooperating with the installation 1 and a homing head associated with an inertial unit.

In the first place, a missile 2 follows a launch trajectory (which may not coincide with the trajectory t) entirely determined by the cooperation of the installation 1 and of the electronic guidance means installed on board the said missile 2. Next, still by virtue of this cooperation by means of a radio frequency transmission symbolized by the arrows f, the installation 1 obliges the defence missile 2 to follow the interception trajectory t towards the interception point F. Finally, when the missile 2 is sufficiently close to the missile 3 and the latter has been locked-on by the homing head of the said missile 2, the latter is guided onto the said missile by the action of the said homing head.

The destruction of the missile 3 by the defence missile 2 is then achieved by commanding a warhead, carried by the said missile 2.

Figure 2:
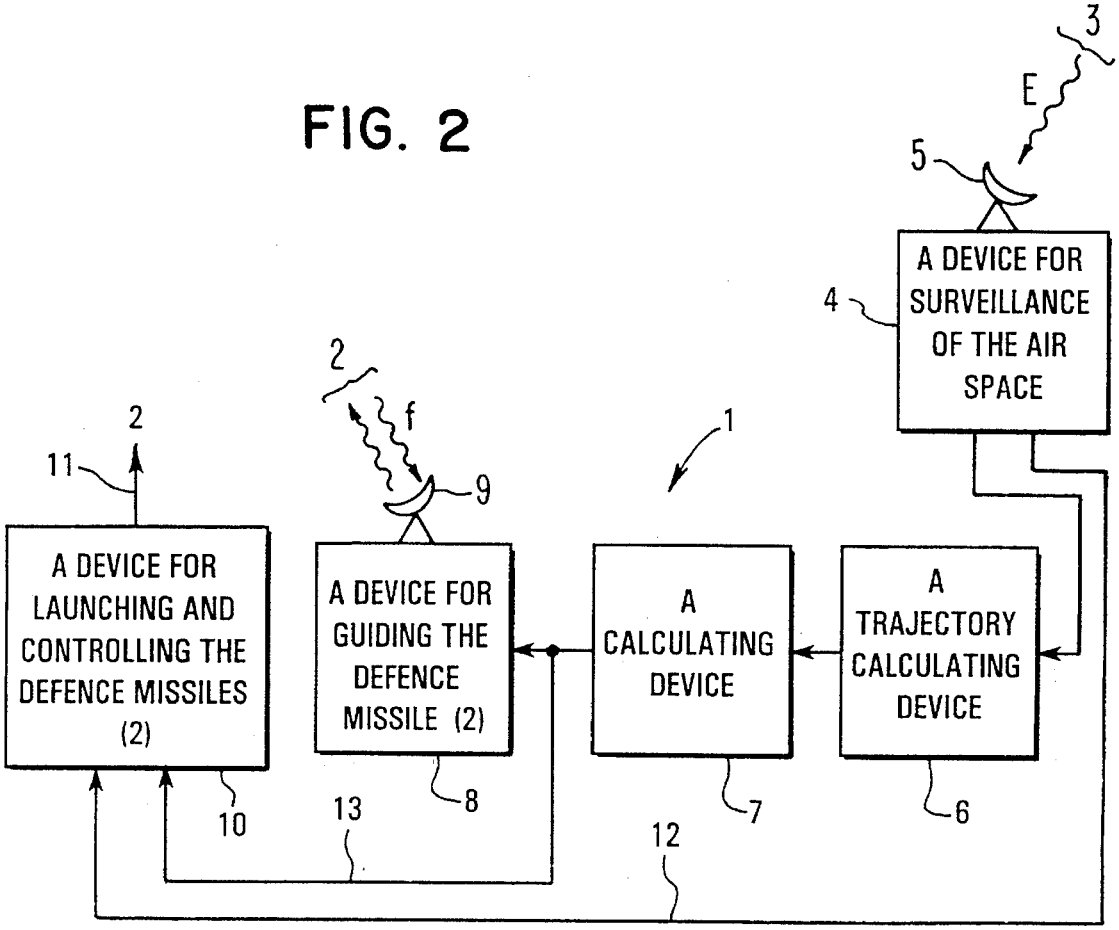
FIG. 2 shows the block diagram of the fixed control installation of the air defence system of the invention.

As FIG. 2 shows, the surveillance and control installation 1 includes, in a usual way:

- a device 4, provided with an antenna 5, for surveillance of the air space to be protected, as well as for the detection and identification of airborne missiles 3. The device 4 may include a surveillance radar or equally an opto-electronic monitoring system. It is quite obvious that the device 4 conditions the effective possibility of an interception and that the time available for this interception is all the greater the longer the range at which the detection and identification of the missile 3 are performed;
- a trajectory calculating device 6 which, from the information received from the surveillance and detection device 4, measures the characteristics of the target 3 (position and speed) and calculates the approach trajectory T. The device 6 may include a normal trajectory calculating radar;
- a calculating device 7 which, from information received from the trajectory calculating device 6, and depending especially on the characteristics of the defence missiles 2, determines the optimal interception trajectory t for a defence missile 2, as well as the instant of launch firing of the latter;
- a device 8, provided with an antenna 9, for guiding the defence missile 2 in flight towards the interception point F; and
- a device 10 for launching the defence missiles 2, controlling the latter over a link 11, receiving information on preparing for the launch of a missile 2 sent by the surveillance and detection device 4 via a link 12 and receiving the firing command and the launch conditions sent by the calculation device 7, via a link 13.

The example of implementation of the defence missile 2, with axis L—L, shown diagrammatically by FIG. 3, includes a propulsive system 20 arranged at the rear; at least one fragmentation warhead 21; an equipment bay 22 enclosing an inertial unit, a computer and a radio frequency transmitter; aerodynamic control surfaces 23 mounted so as to be movable at the end of wings 24; a device 25 for control of the movable aerodynamic control surfaces 23; a homing head which is adjustable in orientation 26; electronics 27 associated with the said homing head 26; a lateral window 28 for the passage of the beam from the homing head 26; a proximity fuse 29; and a front end 30, pointed and tapered.

It is obvious that, in place of including aerodynamic steering control surfaces 23, the defence missile 2 could be provided with a force-steering system, comprising, in a known way, lateral nozzles fed by controllable gas jets.

Moreover, in FIG. 3, the orientable homing head 26 has been illustrated in the form of a homing head with a movable antenna. It is obviously possible to use electronically controlled static antennae, the said static antennae then being pressed against the side wall of the missile 2 at the site of the lateral window 28, which then has no further purpose.

Whatever the practical embodiment of the homing head 26 and of its antenna or antennae 26, it should be noted that, according to essential characteristics of the present invention:

- the homing head 26 is not arranged at the front of the missile 2, but in a position longitudinally intermediate between the nose 30 and the rear propulsive system 20, so that the rounded radome usually provided at the front of the known defence missiles can be replaced by a tapered nose 30, allowing the missile 2 to be elongated and enhancing the aerodynamic performance of the latter. The missile 2 may thus be faster and of higher performance;
- the central axis AD of the homing head 26 is not coincident with the axis L—L of the missile 2, as is always the case in the known defence missiles, but, on the contrary, is inclined laterally by an angle $\theta 1$ with respect to the axis L—L of the said missile, on one side of the latter. This angle $\theta 1$ is a function of the speed VE of the defence missile 2 and of the speed VB of the airborne missile to be intercepted. More precisely, $\tan \theta 1 = VB/VE$ (see FIG. 7). It will be noted that, if VB=2000 m/s and VE=1000 m/s, $\theta 1$ is equal to 63.5 degrees. Moreover, by rotation of the movable antenna of the homing head 26 or by control of the static antennae of the latter, the central axis AD may have a travel $\Delta\theta$ on either side of the mid position corresponding to the angle $\theta 1$. In order to be able to cover a wide speed range for the airborne missiles 3 to be intercepted, the central axis AD is oriented by construction along an angle $\theta 1$ of about 60 degrees, with a travel $\Delta\theta$ of the order of 40 degrees in all directions around the said mid position;
- the proximity fuse 29 is arranged at the front of the missile 2, between the nose 30 and the equipment bay 22. It generates a detection front FP, inclined laterally by an angle $\theta 2$ with respect to the axis L—L of the missile 2, on the same side as the central axis AD of the homing head 26. The angle $\theta 2$ may be of the order of 30 degrees and may possibly be altered. As will be easily understood from what follows, the detection front FP of the proximity fuse 29 may exhibit the form of a plane layer, instead of the usual form of a cone of angle $\theta 2$ centred on the axis L—L. As was mentioned for the homing head 26, the proximity fuse may include a rotary antenna or an electronically controlled static antenna in order to be able to alter the angle θ2 and, by tilting, to orient the said detection front FP so as to enhance the conditions of detecting the airborne missile 2; and the fragmentation warhead 21 is able to project a shower of fragments along an average direction I, at least substantially perpendicular to the axis L—L of the defence missile 2, on the side opposite the central axis AD of the homing head 26 and opposite the detection front FP of the proximity fuse 29.

The devices 4, 6 and 10 of the installation 1 (FIG. 2) may be similar to known devices and operate in a way identical to the latter.

On the other hand, the devices 7 and 8 exhibit features illustrated diagrammatically by FIGS. 4 and 5. As was said above, the trajectory calculating device 6 sends the calculating device information relating to the approach trajectory T, the successive positions of the airborne missile 3 on the trajectory T and the speed VB of the said airborne missile. From this information, as well as from the manoeuvring capabilities and from the emplacement A of the defence missile 2 (and from other factors, such as the point of impact of the debris falling from the intercepted missile 3), the calculation device 7 determines a point F of the approach trajectory T which is favourable to the interception.

Considering the vertical plane AHF passing through the points A and F (H being the horizontal projection of the point F on the ground G), it is advantageous for the interception trajectory t to be planar and to lie in this plane (see FIG. 4).

Moreover, since, according to one essential feature of the present invention, the missile 2 has to intercept the airborne missile 3 abeam, the tangent tg to the trajectory t at the point F is orthogonal to the trajectory T. It therefore lies in the plane π normal at F to the trajectory T. This tangent tg is therefore found to be the intersection of the vertical plane AHF and of the plane π.

Examining the interception trajectory t in the plane AHF (see FIG. 5), it will easily be understood that this trajectory is perfectly defined by the initial tangent ti, vertical for example, at the point A, by the horizontal distance X separating the points A and H, by the vertical distance Z separating the points F and H, and by the angle α which the tangent tg forms with the horizontal, at the interception point F. Taking into account the intrinsic characteristics of the defence missile 2, the interception time DI (duration between the launch firing and arrival at the point F by the missile 2 following the trajectory t) is thus defined by the three parameters X, Z and α. The latter can advantageously be tabulated and prioritized, so that the firing parameters (instant of departure of the missile and guidance commands by the device 8) are established in a very short time.

Thus, the algorithm of the calculation device 7 performs the following operations:

determination of a favourable interception point F;

determination of the vertical plane AHF, passing through the said favourable interception point F and through the emplacement A of the defence missile 2;

determination of the horizontal projection H of the favourable interception point F;

determination of the horizontal distance X between the emplacement A and the point H;

determination of the vertical distance Z between the favourable interception point F and the point H;

determination of the plane π normal at F to the trajectory T of the airborne missile 3;

determination of the inclination angle α, with respect to the horizontal, of the intersection tg of the vertical plane AHF and of the plane π;

determination of the trajectory t of the defence missile 2, in the vertical plane AHF, from the parameters X, Z and α; and determination of the interception time DI of the defence missile 2 following the trajectory t.

Moreover, this algorithm determines the point C of the trajectory t from which the homing head of the defence missile is in a position to lock onto the airborne missile and the point D of the trajectory T corresponding to the estimated position of the said airborne missile at the instant of lock-on (see FIG. 4).

Moreover, from the information delivered by the trajectory calculating device 6, the computer 7 at every instant calculates the flight time DV necessary for the airborne missile 3 to reach the point F by following the trajectory T. Obviously, for an interception to be possible, it is necessary, at the moment of the determination of the interception time DI, for the flight time DV of the missile 3 to be greater than DI. However, the flight time DV is constantly decreasing and, as soon as its value becomes equal to DI, the launch device 10, controlled by the calculating device 7 (over the link 13), fires the said defence missile 2.

Thus, as soon as an airborne missile 3 to be intercepted is detected and identified by the device 4, 5 the latter informs the launch device 10 thereof (over the link 12), as well as the trajectory calculating device 6. Consequently, a defence missile 2 is prepared for launch firing by the device 10 (over the link 11), while the calculating device 7, in the way described above, determines the approach trajectory T, the interception point F, the interception trajectory t, the interception time DI and the flight time DV.

At the instant when the airborne missile 3 reaches the said point B, the launch device 10 launches the said defence missile 2, vertically, for example.

Over the radio frequency link (arrows f) between the guidance device 8, 9 and the defence missile 2, the latter is then guided on the interception trajectory t, in a way similar to the known technology. The device 8, 9 verifies the trajectory calculation of the defence missile 2 and, possibly, alters the acceleration of the said missile 2 about the said interception trajectory, depending on the most recent data on the calculation of the airborne missile trajectory and of the defence missile trajectory, so that the interception of the said airborne missile 3 can take place at a point F, which is then respecified by the calculation device 7. The guidance device 8, 9 then slaves the missile 2 in roll, in such a way that the central axis AD of the homing head 26 is maintained in a plane passing through the interception point F and the positions of the missile 2 and of the airborne missile 3 at least from the moment when the missile 2 has reached the point C.

In flight, the homing head 26 carries out scanning of the space directed towards the airborne missile, by displacing the axis AD in the cone with vertex angle Δθ.

As soon as the homing head 26 has locked onto the airborne missile 3, guidance of the missile 2 is taken over by the said homing head and the associated electronics, which maintain the said missile 2 on the interception trajectory t.

In the terminal phase of the interception, the detection front FP of the proximity fuse 29 of the defence missile 2 detects a point Q on the front of the airborne missile 3. Upon this detection of the point Q, the proximity fuse 29 initiates the fragmentation warhead 21 and the latter projects its shower of fragments along the direction I, substantially perpendicular to the axis L—L of the missile 2 and directed to the side opposite the detection front FP (see FIG. 6).

If, as is represented in FIG. 7, the speeds involved at the instant of the projection of the shower of fragments are plotted out, it is noted that the relative speed VR between the defence missile 2 and the airborne missile 3, due to the fact, on the one hand, of the respective values of the speed VE of the said missile 2 and of the speed VB of the said missile 3 and, on the other hand, of the near-orthogonality of these speeds VE and VB in the vicinity of the point F, is inclined to the speed VB of the said missile 3, as well as to the speed VI of the fragments of the shower projected by the warhead 21, since then the said speed VI is substantially parallel to the speed VB of the missile 3.

Consequently, the relative speed VIR of the said fragments, resulting from the combination of the speeds VI and VR, is inclined by a significant angle θj to the speed VB.

This results in the fragments penetrating within the airborne missile 3, following the direction IR, over a significant angle θj which is favourable to the destruction of the said missile (see FIG. 8). Moreover, the impact of the fragments is close to the nose of the airborne missile 3 due to the large value of the angle θj (about 60 degrees in the example described above). Obviously, if a slight delay appears in initiation of the warhead 21 after detection of the point Q of the airborne missile 3, the fragments reach the latter along a direction IR', substantially parallel to IR, but more rearwards on the said airborne missile (FIG. 8).

Thus, by virtue of the present invention, it is possible to attack faster targets 3 than the known frontal-attack systems allow, with greater effectiveness and very simple control of the terminal phase, since the time window for firing the charge 21 is relatively larger. Moreover, it will be noted that an increase in the speed VE of the defence missile 2 of the invention is favourable to the effectiveness of the charge (in FIG. 7, it is seen that the greater VE is, the more θj increases), whereas it is unfavourable for a frontal-attack defence missile.

I claim:

1. Air defence system capable of intercepting high-speed airborne missiles (3), including a fixed control installation (1) and defence missiles (2), said fixed installation (1) comprising:

detecting means (4, 5) for detecting said airborne missiles (3);

trajectory calculation means (6) for determining the approach trajectory (T) and the speed of such an airborne missile (3), detected by said detection means (4, 5);

calculation means (7) for determining an interception trajectory (t) which one of said defence missiles (2) has to follow in order to intercept said detected airborne missile (3);

launching means (10) for launching said defence missile (2);

guiding means (8) for guiding said defence missile (2); and linking means (9, 11) for linking with said defence missile (2);

and each of said defence missiles (2) comprising a propulsion system (20), at least one warhead (21), an inertial unit (22), a homing head (26), steering devices (23), means for linking (22) with said fixed control installation (1) and a steering commands generator (25) deriving steering commands from information sent by said guiding means (8) provided in said fixed control installation and from information delivered by wherein:

the central axis (AD) of said homing head (26) is inclined laterally with respect to the axis (L—L) of said defence missile (2);

said defence missile (2) is roll-stabilized, so that said central axis (AD) of said homing head is directed to the side of said airborne missile (3); and said calculating means (7) determining the interception trajectory (t) of said defence missile (2):

start by determining a point (F) common to said interception and approach trajectories (t, T), where said interception trajectory is at least substantially perpendicular to said approach trajectory: then in the vertical plane (AHF) passing through said common point (F) and through the site (A) of said defense missile (2) on the ground, determine said interception trajectory (t) of said defense missile (2) from the following three parameters:

the vertical distance (Z) separating said common point (F) from its horizontal projection (H);

the horizontal distance (X) separating said site of the defence missile (2) on the ground (A) from said horizontal projection (H) of said common point (F); and the angle (α) which the intersection (tg) of said vertical plane (AHF) with the plane (π) normal to said approach trajectory (T) of said airborne missile (3), at said common point (F), makes with the horizontal.

2. Air defence system according to claim 1, characterized in that the said calculation means (7):

with the aid of the said three parameters (Z, X, α), determine the interception time (DI) necessary for the said defence missile (2) to cover the said interception trajectory (t) between the said site of the defence missile (2) on the ground (A) and the said point (F) common to the said interception and approach trajectories (t, T);

continuously calculate the flight time (DV) necessary for the said airborne missile (3) to reach the said common point (F) from its current position, by following the said approach trajectory (T); and actuate the said launching means (10) for launching the said missile (2) so that the said launching means (10) perform the launch firing of the missile when the said airborne missile (3) reaches the point (B) of the said approach trajectory for which the value of the said flight time (DV) becomes equal to the said interception time (DI).

3. Air defence system according to claim 2, characterized in that, at the estimated moment of lock-on to the airborne missile (3) by the homing head (26) of the defence missile (2) at the latest, the central axis (A/D) of the said homing head (26) is in the plane (CFD) defined by the position (C) of the missile (2) at this instant, the said common point (F) and the point (D) corresponding to the position of the said airborne missile (3) at this instant, and in that this latter plane (CFD) serves as reference plane for the roll stabilization of the said defence missile (2).

4. Defence missile (2) for the air defence system of claim 1, wherein said central axis (AD) of said homing head (26) is laterally inclined with respect to longitudinal axis (L—L) of said missile (2) in order that said missile (2) looks laterally and said homing head (26) is disposed in a longitudinally intermediate portion of said missile (2).

5. Missile according to claim 4, characterized in that the value (θ1) of the lateral inclination angle of the central axis (AD) of the said homing head (26) with respect to the axis (L—L) of the said missile is chosen in such a way that its tangent is at least approximately equal to the ratio between the speed of the airborne missile to be intercepted and the speed of the said defence missile.

6. Missile according to claim 5, characterized in that the said value (θ1) of the lateral inclination angle of the central axis (AD) of the homing head is at least approximately equal to 60 degrees.

7. Missile according to claim 5, characterized in that the central axis (AD) of the said homing head can be oriented about its mid position corresponding to the said value (θ1).

8. Missile according to claim 7, characterized in that the said central axis (AD) of the homing head (26) can be oriented within a cone, the axis of which is formed by the said mid position.

9. Missile according to claim 4, characterized in that the said warhead (21) is able to project a shower of fragments laterally, on the side opposite the said central axis (AD) of the homing head (26) .

10. Missile according to claim 9, characterized in that the central direction (I) of the said shower of fragments is at least substantially perpendicular to the axis of the said missile.

11. Missile according to claim 4, further including a proximity fuse (29) for detecting such a missile and controlling the said warhead, characterized in that the said proximity fuse (29) forms a detection front (FP) in the form of a plane layer, inclined laterally with respect to the axis (L—L) of the said missile, on the same side as the central axis (AD) of the said homing head (26).

12. Missile according to claim 11, characterized in that the lateral inclination angle (θ2) of the detection front (FP) of the said proximity fuse with respect to the axis of the missile is at least approximately equal to 30 degrees.

13. Missile according to claim 4, characterized in that the said homing head (26) is arranged in an intermediate part of the said missile (2).

* * * * *